United States Patent [19]

Funke

[11] Patent Number: 4,854,382

[45] Date of Patent: Aug. 8, 1989

[54] PLATE HEAT EXCHANGER

[75] Inventor: Karl-Heinz Funke, Gronau/Leine, Fed. Rep. of Germany

[73] Assignee: Funke Warmeaustauscher Apparatebau GmbH, Gronau/Leine, Fed. Rep. of Germany

[21] Appl. No.: 127,482

[22] Filed: Dec. 1, 1987

[30] Foreign Application Priority Data

Dec. 4, 1986 [DE] Fed. Rep. of Germany ..... 3641458

[51] Int. Cl.[4] ..... F28F 3/08

[52] U.S. Cl. ..... 165/167; 165/166; 277/193; 277/199; 277/234

[58] Field of Search ..... 165/166, 167; 277/193, 277/199, 215, 227, 234

[56] References Cited

U.S. PATENT DOCUMENTS 2,616,671 11/1952 Wakeman ..... 165/167
2,846,198 8/1958 Sturges ..... 165/167

FOREIGN PATENT DOCUMENTS 2075656 11/1981 United Kingdom ..... 165/166
2141814 1/1985 United Kingdom ..... 165/166

*Primary Examiner*—Noah P. Kamen
*Attorney, Agent, or Firm*—Allegretti & Witcoff, Ltd.

[57] ABSTRACT

A plate heat exchanger comprising aligned flat heat transfer plates and patterned profiled turbulence plates interposed as spacers between the heat transfer plates. All plates have openings or ports at each of the four corners, some of which are sealed at their periphery so as to direct fluid flow through the flow slits between the heat transfer plates. The gasket seals are part of the turbulence plates and are secured thereto by interlocking corrugations, grooves or keys.

4 Claims, 5 Drawing Sheets

PLATE HEAT EXCHANGER

BACKGROUND OF THE INVENTION

The invention concerns a multi-plate heat exchanger in which flat heat transfer plates are spaced from each other by interposed rough-surfaced plates which produce flow turbulence in fluids flowing through the spaces between the plates.

PRIOR ART

Plate heat exchangers are known, in which several thin, stamped individual plates are joined into a set of plates with the aid of interposed seal or gaskets in such a way that the flow slit formed between the individual plates provides a flow path for two media of different temperature levels, so that a heat exchange takes place through the walls of the plates. The impressions in the plate surfaces determine the flow direction of the media, degree of the turbulence and also support the individual plates in spaced relation. Prior art stamped plates have zig-zag shaped surface patterns, are provided with a sealing gasket on one side which is bonded into a corrugation in the plates and are so placed on top of one another, that the impressions cross. The seals are so positioned in the area around the openings through the plates that, when using all the same plates, the specific inlet and outlet openings for both media alternate from one to the other. An optimal, even flow through the flow slit between the plates is prevented because the crossing of the impressions are adjacent plates which influence the flow on both media sides provide no definite flow direction. By using the same plates, as is usually the case for economic reasons, the inlet and outlet apertures of a flow slit are positively located on the same longitudinal side of the plates. Gaseous or fluid media always seek the shortest path between the inlet and outlet openings and thus do not provide maximum plate contact.

The pressure support of the individual heat transfer plates takes place through the cross-wise superpositioning of the impressions, and is thereby limited in size by the mechanical load-bearing capacity of the material from which the plates are made.

The margins of the openings between plates are alternately sealed or open to the flow slit between plates in order to attain alternating flow of the media. In this construction, the counter-pressure, necessary for sealing between the media, is not one hundred percent guaranteed. It has been attempted, to be sure, to attain a bridge-like support through point-like supports next to the sealing or sealing corrugations in the flow slit; however, since this support is not entirely secure using the thin sheet material, a second seal is provided, spaced at a certain distance from the opening seal which also is provided with lateral supports. The safety space between the two seals is provided with openings directed outwardly, so that, in the event of a leak, a mixing of the media is prevented by discharging the fluid to its own conduit. Thus, surface of the safety space is lost as a heat exchange surface.

Since the plates must be impressed in the closest possible pattern in order to achieve a given turbulence, and also to ensure a specific pressure support, the plate material must not exceed a specific thickness; otherwise cracks would arise in the material. Despite the generally very thin wall thicknesses used for the plates, current dismantling inspections are necessary for safety reasons.

Furthermore, not every material is equally suited for stamping, and the stamping fabricating tensions could also lead to subsequent material cracks, attributable in part to the flow media.

In event of failure of plates due to corrosion, cracks or the like, replacement plates must be obtained from the manufacturer, or else be stored in sufficient quantities.

THE INVENTION

The object of the present invention is to provide a plate heat exchanger, which obviates the disadvantages of the prior art.

In the construction in accordance with the invention, the flow slits between the plates of the heat exchanger are provided by one flat plate and one profiled turbulence plate. This construction has the advantage that the fluid flow through the flow slit is not influenced by the turbulence profiling of the interlocked pattern of adjacent plates. The pressure support between adjacent plates no longer takes place solely at the crossing points of the stamping pattern, but can be individually considered in the design pattern of the turbulence plates only. Through this means, higher pressures can be permitted. By eliminating the profile impressions in the heat transfer plates, the very high stamping pressures are no longer necessary and the danger of cracking which is connected with them is eliminated. Any suitable plate material can be used in any chosen thickness for the flat heat transfer plates, independently of the stamping capacity. By selecting thicker heat transfer plates, the use of higher pressures is possible, and, above all else, security against corrosion of the material can be significantly improved. The flat heat transfer plate provided in accordance with the invention furthermore has the advantage that replacement plates can be produced from sheet metal plates available commercially in any workshop and without significant expense.

The profiled turbulence plates can be manufactured from sheet metal or plastic. In the event of formation from plastic, it is advantageous to form the seal around the periphery of the plates and around the flow openings through the heat exchanger in a single piece with the turbulence plate.

The pressure support of the flat heat transfer plates and the optimal turbulence for the specific medium within the flow slit can be obtained by controlling the design of the profile pattern on the turbulence plate only. The same set of plates can be used for both media.

Because the turbulence plates of the invention are provided on both sides with a turbulence profile and a seal or gasket, an exchange of the inlet and outlet openings to and from the space between the plates can be achieved by rotating the turbulence plate around its own axis by 180°, even if the inlet and outlet openings for the specific medium lie diagonally opposed.

This structure, together with the precise guiding of the media, attained by means of the turbulence profile pattern on the turbulence plate provides a particularly uniform flow through the flow slit between plates. In one form of the invention, the pattern has grooves extending laterally to the direction of flow to provide transfer, particularly if the flow quantity of one of the media is small.

In a preferred form of the invention, the turbulence plates have a groove around the opening to be sealed, and the sealing gasket has a complementary projection to prevent the seal from slipping out from between the plates. The construction of the invention also makes it possible to lay all connections down on one side of the plate heat exchanger, that is, on one of the end pressure plates.

In accordance with the invention, a particularly good tightening of the sealing is attained thereby reducing the danger of the exiting of the media, or the danger of the mixing of the same. To increase the level of safety, the sealing gasket between plates and surrounding the openings through the plates, may contain grooves so that the pressure on the gasket is increased.

If desired, the turbulence plates can be composed of several parts. This is of advantage for technical manufacturing and economic reasons, particularly in the case of large plate heat exchangers. If it is not necessary to clean or exchange plates which have been damaged by corrosion or the like, the plates may be permanently connected to one another by welding, cementing or the like.

By making all connections to the heat exchanger through a pressure plate at the front end, the plate heat exchange can be installed directly on a tank, whereby the outflow takes place through the rear pressure plate into the tank.

THE DRAWINGS

The invention will now be illustrated in greater detail by means of the attached drawings in which.

Figure 1:
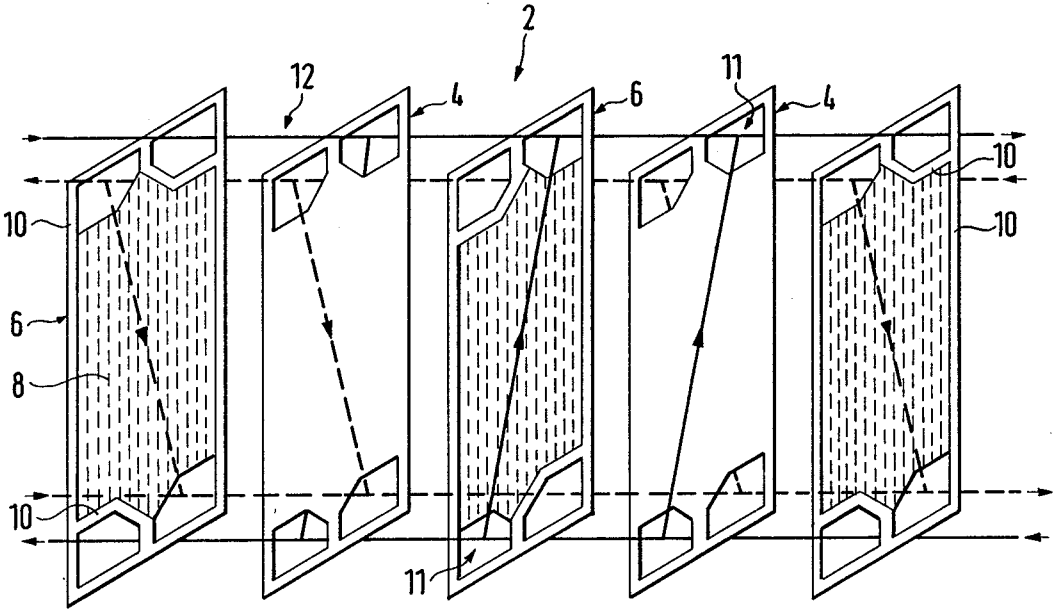
FIG. 1 is a diagrammatic view of a set of plates of a heat exchanger constructed in accordance with the invention.

FIG. 1 depicts a set of plates 2 of a plate heat exchanger with alternately sequenced heat transfer plates 4, which are formed as flat plates, and turbulence plates 6 which have seal gaskets 10 around the periphery of turbulence plates around the margin of certain of the flow openings 11. By means of pressure plates (not shown) on the end of the assembled heat exchanger, which plates also accommodate the regular connections to the exchanger, the flat heat transfer plates 4 and turbulence plates 6 are joined together to form a set of 2. The turbulence plates 6 may be made of metal or plastic. Flow slits 12 are formed between the faces of adjacent heat transfer plates 4 and turbulence plates 6. In FIG. 1, the solid lines with arrows show the flow path of one fluid medium while the dotted lines with arrows show the flow path of the other fluid medium.

The turbulence profiling or pattern in the face of successively positioned turbulence plates influences, in cooperation with the flat heat transfer plates 4, only a single flow slit. Through various turbulence plate designs adapted to the media, it is possible to attain an individual and optimal heat transfer. The turbulence plate can be individually designed for the mutual pressure support of the flat heat transfer plate and turbulence plate. It is simplest to press the turbulence profiling firmly against the heat transfer plates, for the purpose of pressure support. Through this means, the pressure support takes place over a relatively large surface, which makes possible the application of higher pressures; furthermore, an increase of the heat exchange surface is attained as a result.

Figure 2:
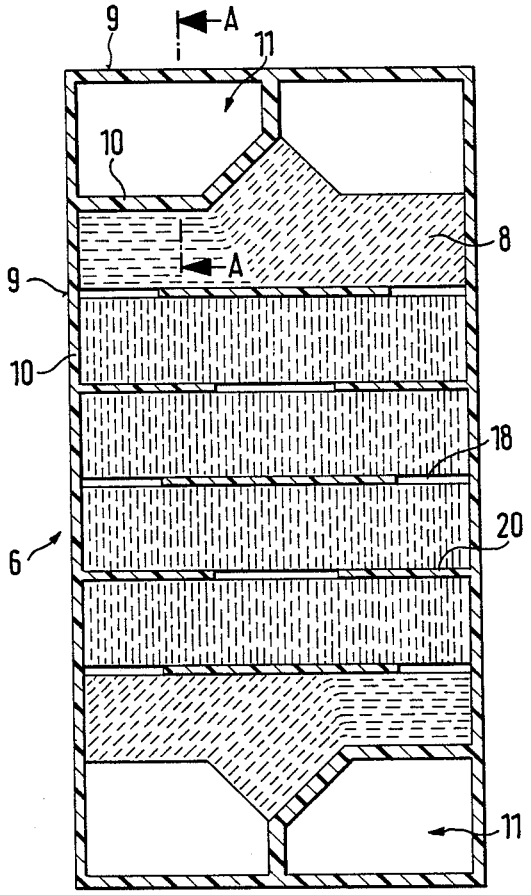
FIG. 2 is a schematic elevational cross-section of a turbulence plate used in the plate heat exchanger in accordance with the invention.

FIG. 2 depicts an individual turbulence plate from one side. The turbulence plate 6 is provided with a seal 10 running along its periphery and which also surrounds two diagonally positioned flow openings 11.

Figure 3:
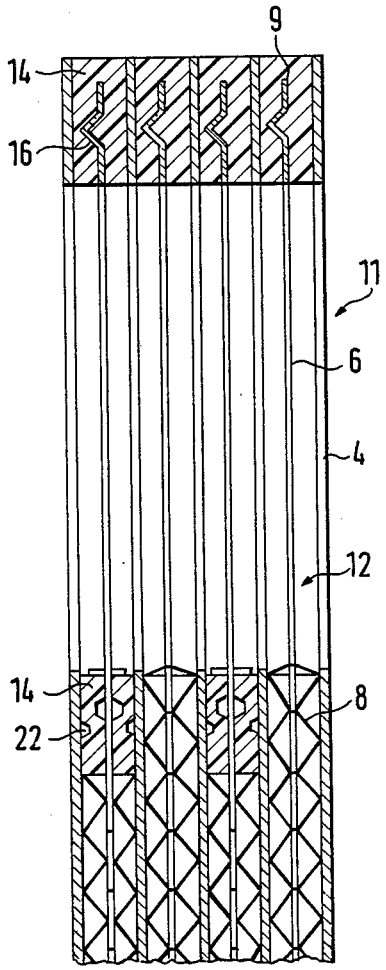
FIG. 3 is an enlarged section taken through the corner of a set of stacked plates in the position along A—A of FIG. 2.

Instead of seals only on the sides, a profile seal 14 in accordance with FIG. 3 can also be provided, which is closed over the top edge 9 of the turbulence plate. The seal 14 can be vulcanized on. The turbulence plate in the area of the profiling seal 14 preferably has a corrugation or groove 16 which makes a form-locking connection with the profile seal 14 and prevents the slipping out of the seal.

Figure 5:
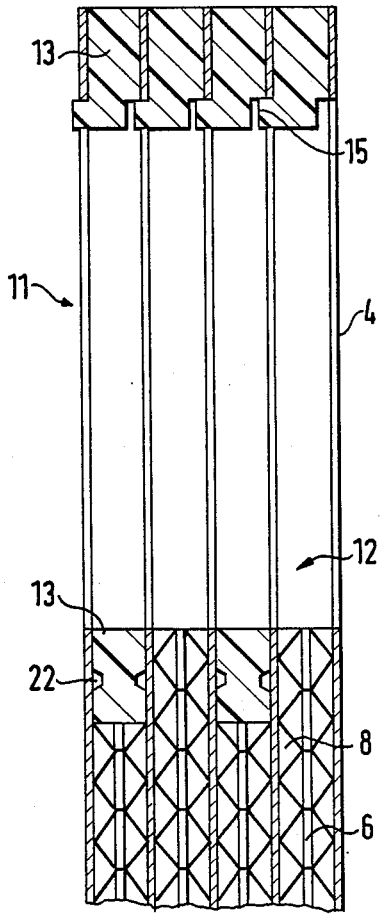
FIG. 5 is a view similar to FIG. 3 showing a further modification of the sealing means.
Figure 4:
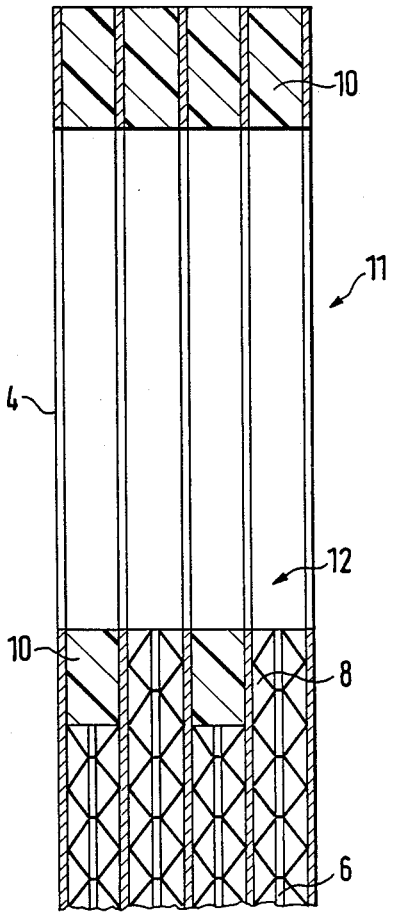
FIG. 4 is a view similar to FIG. 3 showing a different sealing means.

If the turbulence plates 6 are produced from plastic, the seals 13 are integrally joined or molded as a single piece with the turbulence plates, as shown in FIG. 5. This integral seal is provided both around the edge of plates 6 as well as in the margin around the flow openings 11. In order to attain a secure fitting, the molded seal 13 has a projecting edge 15, which engages the margin of the flow opening of the flat heat transfer plate 4, in order to support the turbulence plate in the area of the flow opening of the heat transfer plate.

In order to support the seals 10, 13, 14 in the area of the flow opening 11 through the flow slit, supporting ribs can be provided, or the turbulence profiling can be formed in such a way as to proceed directly through, in order to attain a good tightening of the sealing. In order to increase security, a groove 22 can be provided in the center of the seal, as is shown in FIGS. 3 and 5, which is conducted externally and, upon the exiting of the media, prevents a mixing of the media in a secure manner.

The sealing of the individual plates of the heat exchanger against one another with the help of the described seals facilitates the cleaning and the exchange of the plates. If this function is dispensed with, then the plates can also be permanently welded, soldered, or bonded together with one another. The plates shown have, as is normally the case, a rectangular form. They can, however, also be square or have another form.

Figure 6:
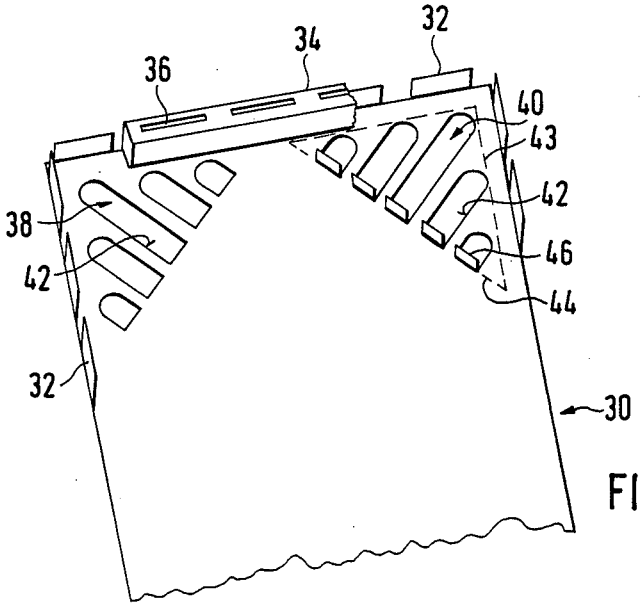
FIG. 6 is a perspective view of form of a flat heat transfer plate with a special sealing means.

FIG. 6 shows a particularly advantageously formed, flat heat transfer plate 30. Individual projections or tabs at the periphery 32 extend roughly vertically from the surface of the plates, in order to create form-locking and/or friction-locking accommodations for a sealing strip 34. The projections have the form of individual tabs, which are spaced from one another and preferably have the same dimenions. They are depicted as rectangular in the drawing. Other shapes are also possible. The sealing strip 34 has slots 36 therethrough, spaced as the projections which receive the projections. Through these complementary parts, a particularly good and stable fit of the sealing is attained.

The flow openings 38, 40 provided in the corners of the heat transfer plate 30 are formed in a triangular configuration. They preferably consist, in order to increase their stability, of individually positioned slotted holes 42, the external contours 43 of which form a triangle.

The base 44 of the triangle is aligned roughly in the direction of the plate diagonal. The flow openings 40 which do not connect with the flow slit, have tabs 46 projecting from the edge of the plate for the form-locking and/or friction-locking accommodation of a sealing strip (not shown), which is formed with slots like the sealing strip 34.

The projections 46, like the edge projections 32, are bent up from the plate and are preferably formed exactly to the size of the projections 32, although the projections 46 shown in the diagram appear smaller than the projections 32, for the purpose of clearer representation.

Figure 7:
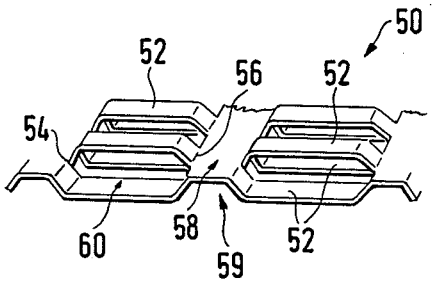
FIGS. 7 and 8 are perspective views of two design patterns for turbulence plates.

FIG. 7 shows a part of a particular design for a turbulence plate 50, in which a number of individual sheet metal parts 52 are stamped out and extend alternately above and below the plane of the plate, in such a manner that the sheet metal parts 52 remain connected wth the plate 50 at their opposing ends 54, 56 The sheet metal parts 52 preferably have the form of narrow, rectangular or trapezoidally bent-out strips, which are positioned in uniform rows. This arrangement provides flow channels 58, 59, 60, between the rows of strips on both sides of the plate 50 and surrounded by the alternately positioned sheet metal strips 52.

In the assembled condition, these flow channels run roughly diagonally of the plate. The strips have a relatively large external surface which serves as a pressure bearing surface, through which a particularly good pressure support of the plates in the set is attained.

Figure 8:
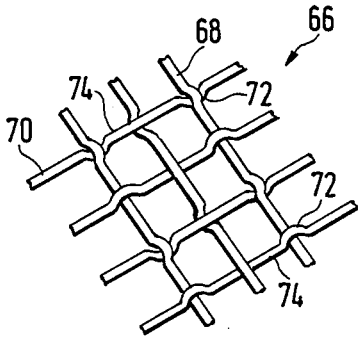

FIG. 8 shows a part of still another configuration of a turbulence plate formed as a crossing lattice. The grid rods or grid wires 68, 70 are interwoven in a rippling form. Every rod or wire has a series of relatively short bent sections 72, alternating with relatively long, straight sections 74, which serve to provide pressure support.

Figure 9:
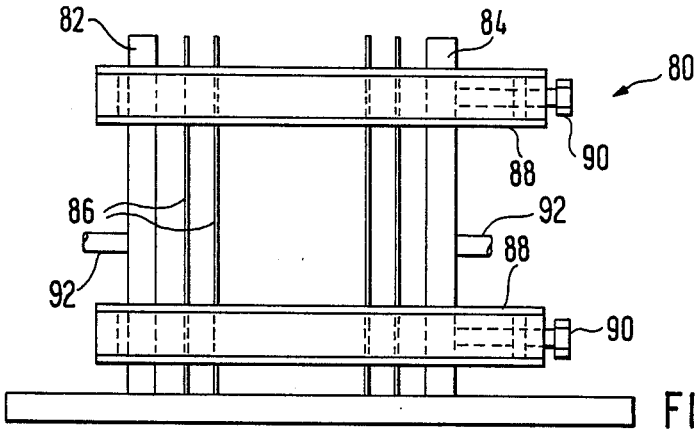
FIGS. 9 and 10 are schematic representations of means for pressing and holding together a set of plates.
Figure 10:
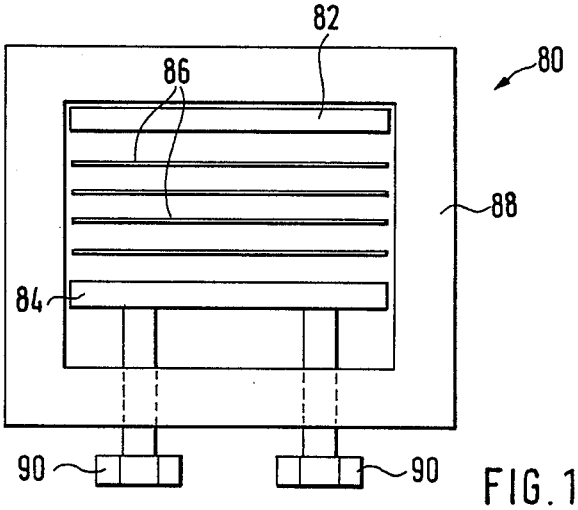

Referring to FIGS. 9 and 10, a clamping device 80 serves to press together the heat exchange transfer plates 86 which are located between pressure plates 82, 84 with fittings 92. The clamping device has at least one rectangularly shaped pressing frame 88 surrounding the set of plates 82, 84, 86, in the one side of which at least one pressure screw 90 is positioned, by means of which screw pressure can be exerted on the pressure plate 84. The pressing frame 88 consists, for example, of U-shaped yokes which are welded together. This formation has the following advantages: the frame forms a guide for the plates 82, 84 86, so that special guiding means which are part of the current state of the art, can be eliminated With the help of several pressure screws 90, an even pressure can be exerted on the pressure plate 84, so that the danger of protrusions and dislocations of the plates of the heat exchanger is avoided. The pressure plate 82 is supported on the side adjacent plates 86 over a large area and on the other side by the pressing frame. The danger referred to exists in the case of the use of clamping screws of the type previously used, which are positioned outside the set of plates.

I claim:

1. In a plate heat exchanger comprising (a) a series of flat heat transfer plates;

(b) profiled turbulence plates interposed between said heat transfer plates to provide a flow slit therebetween;

(c) a pair of spaced openings at the top and the bottom of each of said plates, said openings being aligned to provide a fluid passage through said plates, normal to the plane of said plates;

(d) gasket seals surrounding diagonally-opposed openings in said turbulence plates, said gasket seals being disposed in sealing contact with margins of adjacent heat transfer plates so that fluid flow from said openings to said flow slits is in opposite directions in adjacent flow slits; and (e) means for compressing said plates into a unitary heat exchanger, the improvement in which said openings in said heat exchange plates consist of a series of diagonal slots in the corners of said plates, said slots being of such size and shape as to form a triangular configuration at said corners.

2. The heat exchanger of claim 1 which includes tabs projecting upwardly from said plate corners and from the base of said triangle and in which said gasket seals have slits to receive said tabs to secure the seal to said margin.

3. The heat exchanger of claim 1 which includes pressure plates at the ends of said assembled heat transfer and tubulence plates and fittings mounted on said pressure plates for connecting to said heat exchanger.

4. The heat exchanger of claim 1 wherein said turbulence plates are formed as a woven cross grid from wire, each wire having short bends spaced along its length, said bends mating with straight segments between the bends of crossing wires, the straight segments serving for pressure support.

* * * * *